US009739491B2

(12) United States Patent
Beermann et al.

(10) Patent No.: US 9,739,491 B2
(45) Date of Patent: Aug. 22, 2017

(54) EASY MAINTENANCE ACCESS SYSTEM FOR INSULATED COOLER UNIT

(71) Applicant: A-HEAT ALLIED HEAT EXCHANGE TECHNOLOGY AG, Vienna (AT)

(72) Inventors: Martin Beermann, Schoengeising (DE); Johann Lindenmueller, Maisach (DE)

(73) Assignee: A-HEAT ALLIED HEAT EXCHANGE TECHNOLOGY AG, Vienna (AT)

( * ) Notice: Subject to any disclaimer, the term of this patent is extended or adjusted under 35 U.S.C. 154(b) by 1 day.

(21) Appl. No.: 14/780,042

(22) PCT Filed: Mar. 19, 2014

(86) PCT No.: PCT/EP2014/055544
§ 371 (c)(1),
(2) Date: Sep. 25, 2015

(87) PCT Pub. No.: WO2014/166715
PCT Pub. Date: Oct. 16, 2014

(65) Prior Publication Data

US 2016/0047560 A1 Feb. 18, 2016

(30) Foreign Application Priority Data

Apr. 9, 2013 (EP) ..... 13162956

(51) Int. Cl.
*F24F 1/02* (2011.01)
*F25D 29/00* (2006.01)
*F24F 1/04* (2011.01)

(52) U.S. Cl.
CPC ..... *F24F 1/027* (2013.01); *F24F 1/04* (2013.01); *F25D 29/003* (2013.01); *F24F 2221/125* (2013.01); *F24F 2221/36* (2013.01)

(58) Field of Classification Search
CPC ..... F24F 1/04; F24F 1/027; F24F 2221/125; F24F 2221/36; F24F 13/20; F24F 13/10; F24F 13/22; F24F 1/20; F25D 29/003
(Continued)

(56) References Cited

U.S. PATENT DOCUMENTS

2004/0253098 A1 12/2004 Hancock
2005/0039480 A1* 2/2005 Kim ..... F24F 13/20 62/262

(Continued)

FOREIGN PATENT DOCUMENTS

DE 202012001340 U1 3/2012
EP 0 066 364 A1 12/1982
FR 2 965 735 A1 4/2012

OTHER PUBLICATIONS

International Search Report and Written Opinion dated Jun. 2, 2014 in PCT/EP2014/055544, Filed Mar. 19, 2014.

*Primary Examiner* — Mohammad M Ali
(74) *Attorney, Agent, or Firm* — Global IP Counselors, LLP

(57) ABSTRACT

An insulated cooler unit that produces cooled air is disclosed. The cooler unit includes, within a thermally-insulated housing chamber, an inlet for introducing air to be cooled, an outlet for exiting of cooled air, an air heat exchanger for cooling air, a first fan. The cooler unit additionally includes a first track member having a first channel member, at least one first sliding member configured to slide within the first channel member. The first fan is connected to the first sliding member and is slidably mounted in the first track member by the at least one first (Continued)

sliding member, and is capable of being slidably moved over a portion of a first length of the first track member.

20 Claims, 4 Drawing Sheets

(58) Field of Classification Search
USPC ..... 62/77, 302
See application file for complete search history.

(56) References Cited

U.S. PATENT DOCUMENTS

| | | | | |
|---|---|---|---|---|
| 2010/0041327 | A1* | 2/2010 | Desler | F24F 1/0007 454/184 |
| 2012/0242206 | A1* | 9/2012 | Gasser | F24F 1/027 312/236 |
| 2012/0276836 | A1 | 11/2012 | Stewart et al. | |

* cited by examiner

EASY MAINTENANCE ACCESS SYSTEM FOR INSULATED COOLER UNIT

CROSS-REFERENCE TO RELATED APPLICATIONS

This application is a U.S. National stage application of International Application No. PCT/EP2014/055544, filed Mar. 19, 2014, which claims priority to EP Application No. 13162956.0 filed Apr. 9, 2013, the contents of each of which is hereby incorporated herein by reference.

BACKGROUND

Field of Invention

The present invention relates to an insulated cooler unit for producing cooled air. The present invention also relates to a process for using said insulated cooler unit in providing cooled air to a refrigeration or freezer room or an air conditioning system in fluid communication with the unit.

Background Information

The generation of cooled air is of use for cooling processes or for cooling of storage rooms or air conditioning of buildings and warehouses. In such applications cooled air may be used for air-conditioning purposes or for processes of direct convective cooling.

Various types of insulated cooler units for producing cooled air are known. For example, DE 20 2012 001 340 U1 discloses an air cooler assembly comprising two superposed levels in an insulating housing in which the lower level contains a negative pressure chamber and a guide chamber and the upper level contains a positive pressure chamber. In operation, the air to be cooled flows into the negative pressure chamber and through the air heat exchanger and into the deflection chamber and fans in a vertical axis orientation in the upper positive pressure chamber suck the cooled air radially into the positive pressure chamber.

Such known insulated cooler units may be effective in producing cooled air, especially when energy efficient direct-drive electronically commutated (EC) fans are used. Though relatively compact, EC fans are typically relatively heavy (about 150 to 220 kg). The high mass of the EC fans makes it difficult and inconvenient to mount them in the insulated cooler unit, or to remove them for service or repair, or to exchange them for other fans.

In conclusion, it would be desirable to have a insulated cooler unit in which the fans are easily mountable, removable and exchangeable. Furthermore it would be preferred if at the same time, as part of an Easy Maintenance Access System (EMAS), the air heat exchanger of the unit would also have improved accessibility for ready inspection, maintenance and cleaning.

SUMMARY

Starting from this state of the art, it is an object of the invention to provide an insulated cooler unit for producing cooled air that does not suffer from the previous mentioned deficiencies, particularly lack of ready mounting, dismounting and exchange of the fans. Further objects of the invention include provision of a process for using the insulated cooler unit in providing cooled air to a refrigeration or freezer room or an air conditioning system in fluid communication with the unit.

According to the invention, these objects are achieved by an insulated cooler unit for producing cooled air, comprising within a thermally-insulated housing chamber: an inlet for introducing air to be cooled, an outlet for exiting of cooled air, an air heat exchanger for cooling air, and a first fan.

According to the invention, these further objects are achieved by a process for providing cooled air to a refrigeration or freezer room or an air conditioning system in fluid communication with the unit.

The present invention achieves these objects and provides a solution to this problem in that the unit additionally comprises a first track member, optionally having a first channel member, one or more first sliding member(s) adapted to slide over the first track member or within the optional first channel member. The first fan is connected to the first sliding member and the first fan is slidably mounted in the first track member by the first sliding member(s), and wherein the first fan is capable of being slidably moved over a portion of a, preferably an entire, first length (L1) of the first track member. As a result of this capability for slidably mounting and slidable motion, the fans are easily mountable, removable, exchangeable and servicable. Thus an Easy Maintenance Access System (EMAS) is achieved by the present invention.

In the present application, "slidably mounted" means mounted in way such that it is capable of sliding or being slid, and "slidably moved" means moved by sliding or being slid.

In one embodiment of the insulated cooler unit, the unit additionally comprises one to four, preferably two, further fan(s) each connected to at least one further sliding members. Each further fan is slidably mounted in the first track member by the further sliding member(s), and each further fan is capable of being slidably moved over a portion of a, preferably an entire, first length (L1) of the first track member. Depending on the size and desired capacity of the unit, the presence of further fans may be beneficial or required. These further fans will likewise benefit from being slidably movable for ready mounting, removal and exchange.

According to another embodiment of the unit, a mounting space is located between each of the first fan and any further fan(s). The presence of a mounting space is beneficial in providing space for personnel, for example, standing room, when mounting, dismounting, replacing, inspecting, maintaining or repairing the fan(s) or other components of the insulated cooler unit. To get in between the fans, one may cross the coil of the air heat exchanger on the upper side (static allows to stand on top of the coil), if necessary by help of a small step or ladder. Generally this only concerns centrally-located fans (e.g. the middle fan in the case of a unit having three fans), as the side-located fans (e.g. the right and left fan in the case of a unit having three fans) can be easily accessed from the sides. It is noted that in a preferred embodiment, all fans are wired to a separate junction box, and this means that no direct access to the fan junction box is needed.

According to yet another embodiment of the unit, each of the first fan and any further fan(s) are an electronically commutated (EC) fan. EC fans combine the advantages of AC and DC voltages in that the motor runs on a DC voltage, but with an AC power supply. The EC motor incorporates voltage transformation within the motor, and EC motors advantageously have considerably lower energy losses compared to other electric motor types.

In still yet another embodiment of the unit, each of the first fan and any further fan(s) are mounted on the first track member via the first sliding member and any further sliding member(s) in a manner such that a direction of the air flow of each of the first fan and any further fan(s) is substantially perpendicular to a longitudinal axis of the first track member. "Substantially perpendicular" in this application encompasses minor deviations from the perpendicular of less than about 10 degrees. The substantially perpendicular orientation of air flow to the longitudinal axis is beneficial in enabling an easy construction of the unit. For example, the thermally-insulated housing chamber may conveniently be constructed in an approximately box-shaped form, and the fan(s) may conveniently be mounted, dismounted and exchanged by a track member entering the unit from the side. Additionally this orientation of air flow to longitudinal axis minimizes the required size and "footprint" of the track member when the unit comprises multiple fans mounted on the first track member. Furthermore the required size of closable openings for admitting the fans into the housing chamber is favourably minimized. Similar benefits in ease of construction, operation and minimization of footprint are obtained in a further related embodiment in which the first fan and any further fan(s) are mounted in a horizontal axis orientation. These favourable geometrical aspects of the unit will be further exemplified in the drawings discussed later.

Other embodiments of the unit relate to other aspects of its Easy Maintenance Access System (EMAS). In one embodiment, the thermally-insulated housing chamber comprises an access space suitable for the entrance of a person, wherein the access space is located on one side of the air heat exchanger, and the first fan and any further fan(s) are located on an opposite side of the air heat exchanger from the access space. The provision of this access space facilitates the thorough and easy cleaning of the air heat exchanger by maintenance personnel. Providing the access space on the opposite side from the fan(s) assists in beneficially minimizing the footprint.

In another embodiment, the air heat exchanger may be accessed for inspection or cleaning purposes by a first closable opening, located above the air heat exchanger and with the first closeable opening preferably oriented horizontally. The provision of the first closable opening above the air heat exchanger allows a maintenance person to have ready access while standing next to the unit and without the need for ergonomically-disfavourable motions such as bending or straining. Providing the opening in a horizontal orientation allows maximum access to the heat exchanger from above. These features also favourably minimize the footprint of the unit, as will be further exemplified in the drawings discussed later.

In another embodiment the unit further comprises: one or more further track member(s), each optionally having one or more further channel member(s), one or more further sliding members adapted to slide over the further track member(s) or within the optional further channel members. The first fan and any further fan(s) are connected to the further sliding members and the first fan and any further fan(s) are slidably mounted in the further track members by the further sliding member(s). Therefore the first fan and any further fan(s) are capable of being slidably moved over a portion of a, preferably an entire, first length (L1) of the further track member(s). The provision of further track members beneficially allows for improved stability and weight distribution of the fan(s) on multiple track members. The provision of multiple track members also reduces the complexity, wear and footprint of the individual track members.

The track members, 40 and 46, and sliding members, 50 and 52, are not specifically limited as to shape or form so long as they provide the function of a track and a slide. It is noted that flat metal surfaces slides well over flat metal surfaces. So for example, a track member, 40 or 46, may be readily constructed on a flat metal surface (e.g. on a metal plate) by simply providing the plate with guide rails on one, or preferably two, sides of the track member. Sliding members, 50 and 52, in the form of sliding plate-like metal pieces will then readily be guided and slid thru the track member, 40 or 46, thus created. In a preferred embodiment, two track members, 40 or 46, will be created on a metal plate by installing two such pairs of guide rails. In an alternative embodiment, one or more track members, 40 or 46, may conveniently be created in a metal plate by slots to form optional channel members, 42 or 48.

In still another embodiment of the unit, the first track member and the optional first channel member and any further track member(s) and any further channel member(s) extend a second length (L2) outside at least one, preferably two walls of the chamber. The second length (L2) is preferably longer than a width (W) of the first fan, and the chamber has at least one, preferably two further closable openings. Each further closable opening is suitable for opening such that the first fan and any further fan(s) may slide out of the chamber over at least a portion of the, preferably an entire, second length (L2) of the first track member and any further track member(s). Each further closable opening is suitable also for closing such that the chamber may remain thermally insulated. By allowing the first fan and any further fan(s) to be completely slid out of the chamber, the heavy fans may be readily mounted, serviced or exchanged in this slid-out position. In a further specific embodiment, the further closable opening(s) comprise a door for simplicity and ease of construction and use.

Other aspects of the invention concern a refrigeration or freezer room or an air conditioning system in fluid communication with the insulated cooler unit of the invention, and a process of using the unit of the invention in providing cooled air to a refrigeration or freezer room or an air conditioning system in fluid communication with the unit.

BRIEF DESCRIPTION OF THE DRAWINGS

The invention will be explained in more detail hereinafter with reference to various embodiments of the invention as well as to the drawings.

DETAILED DESCRIPTION OF THE EMBODIMENTS

Figure 1:
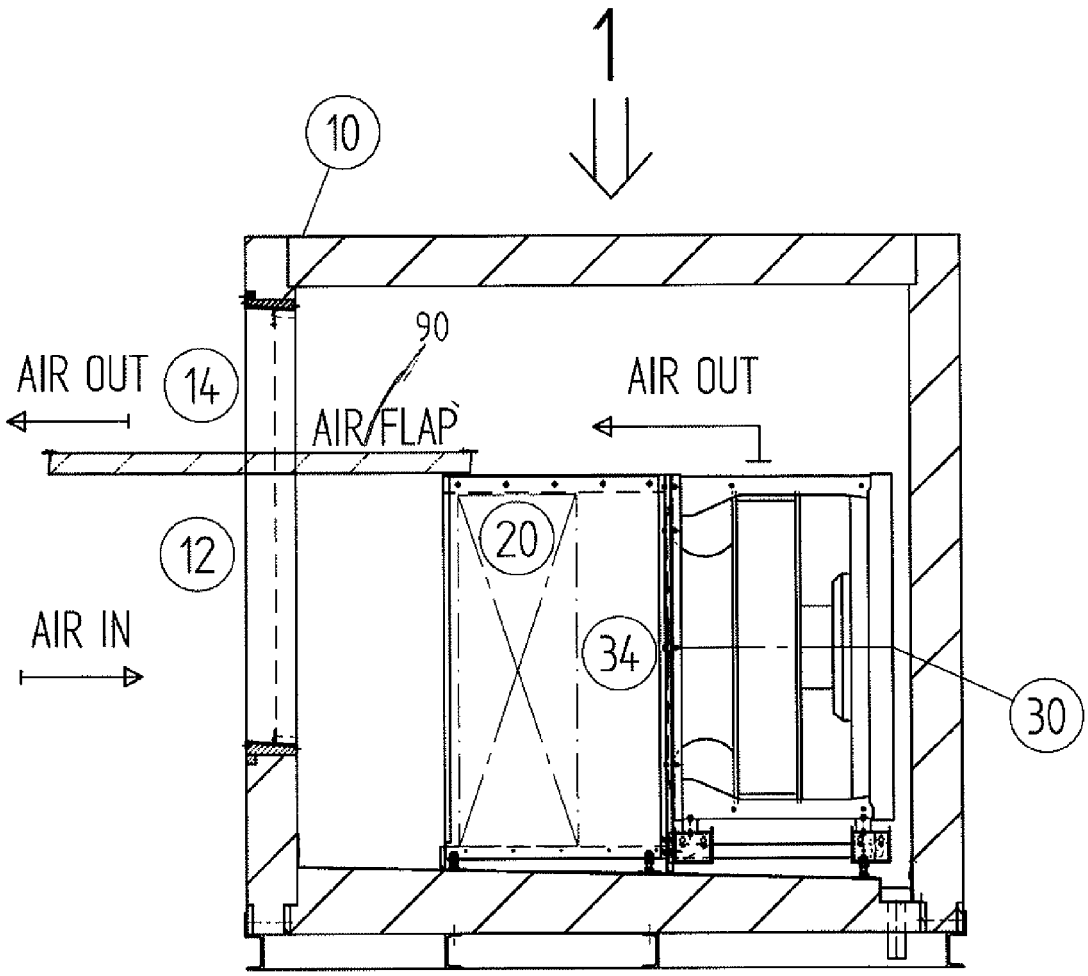
FIG. 1 shows a schematic view of an embodiment of an insulated cooler unit according to the invention.

FIG. 1 shows a schematic view of an embodiment of an insulated cooler unit for producing cooled air according to the invention, which as a whole is labeled with reference number 1. The unit 1 is not specifically limited as to form, shape, construction or composition unless specifically indicated otherwise. The unit 1 comprises within a thermally-insulated housing chamber 10:

an inlet 12 for introducing air to be cooled, an outlet 14 for exiting of cooled air, an air heat exchanger 20 for cooling air, a first fan 30, wherein the unit 1 additionally comprises:

a first track member 40, optionally having a first channel member 42, one or more first sliding member(s) 50 adapted to slide over the first track member 40 or within the optional first channel member 42, wherein the first fan 30 is connected to the first sliding member 50 and wherein the first fan 30 is slidably mounted in the first track member 40 by the first sliding member(s) 50, and wherein the first fan 30 is capable of being slidably moved over a portion of a, preferably an entire, first length (L1) of the first track member 40.

The positions of the inlet 12 and outlet 14 are not specifically limited, and the unit 1 may have additional inlets and outlets, as required for the specific application. In a preferred embodiment, air regulation for the inlet 12 and outlet 14 is conveniently controlled by one or more air flaps 90, preferably a single air flap 90 as shown in FIG. 1. Likewise the type, number and position of air heat exchanger(s) 20 is not specifically limited and may vary for the specific application.

Insulated cooler units 1 and their construction and operation are well known in the art, for example, as disclosed in Refrigeration and Air Conditioning, $2^{nd}$ edition, by C P Arora, published in New Delhi by Tata McGraw-Hill in 2006 (ISBN-13: 978-0074630105) or Refrigeration And Air Conditioning by Ahmadul Ameen, published in New Delhi by Prentice-Hall of India in 2006 (ISBN-13: 978-8120326712).

Unless specifically indicated otherwise, conventional construction materials and means, as well as components and auxiliaries, may be used for the insulated cooler unit 1, and the unit 1 may be operated in a process for producing cooled air in a conventional manner using conventional process parameters such as operating temperatures, operating pressures, and residence times as known in the art. For example, these cited reference textbooks disclose a variety of conventional components and auxiliaries such as heat exchangers, refrigerants, defrosting devices, fans, fan configurations, thermally-insulated housing chambers, cavities, air ducts, control devices, and air flow paths, distributors, adjustable flaps for regulating or blocking air flow, manifolds, baffles, deflectors, and internals for use in or with insulated air cooler units, as well as the process of using such units in supplying cooled air to refrigeration and freezer rooms and air conditioning systems. Although not shown in the schematic drawings for simplicity, one skilled in the art will understand that such conventional components, auxiliaries, and air flow paths may be used without limitation in the invention.

Also shown in FIG. 1, the first fan 30 is mounted in a manner such that a direction 34 of the air flow of the fan 30 is substantially perpendicular to a longitudinal axis 44 of the first track member 40.

Figure 2:
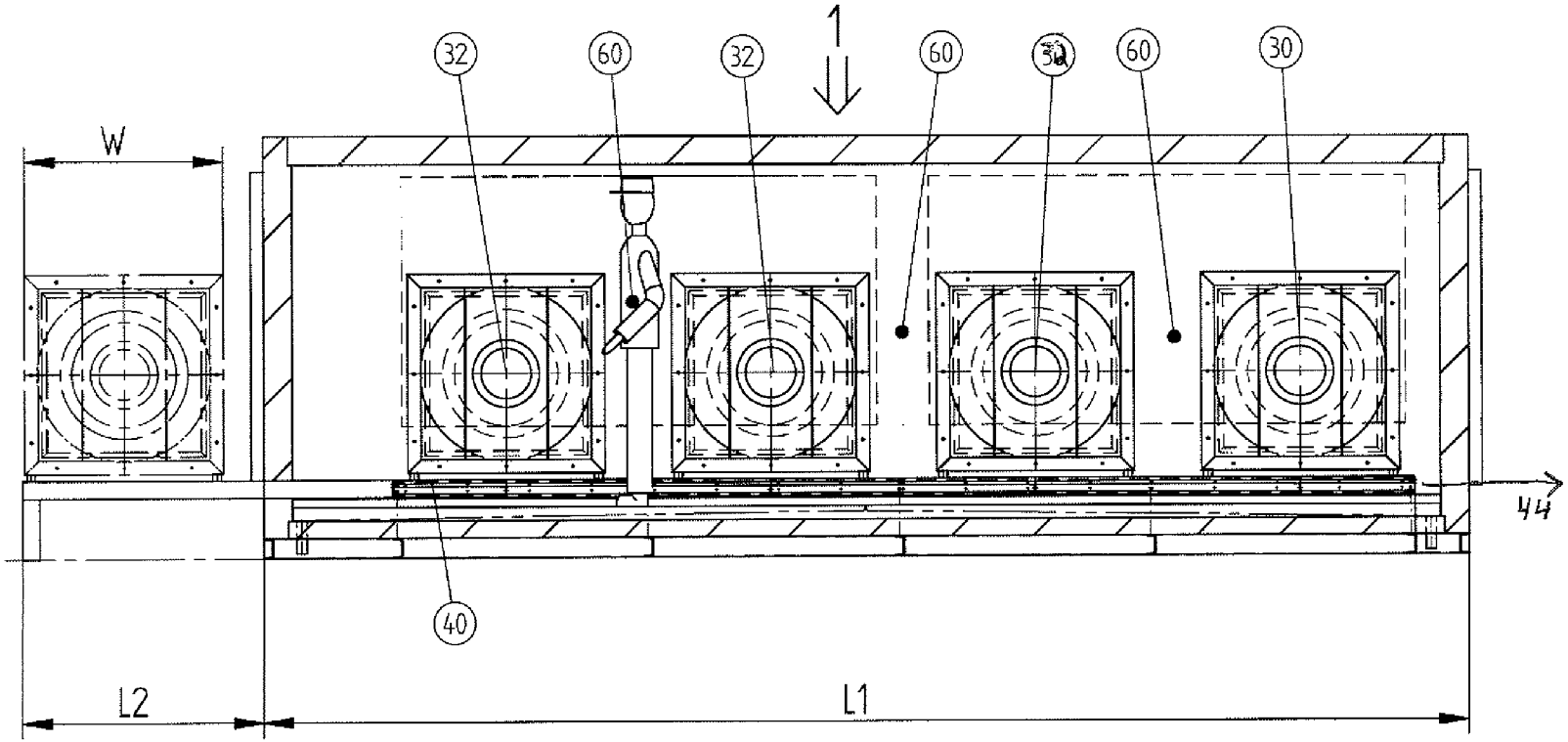
FIG. 2 shows a schematic view of another embodiment of an insulated cooler unit of the invention additionally comprising two further fans and with the first track member extending a second length (L2) outside a wall of the thermally-insulated housing chamber.

FIG. 2 shows a schematic view of another embodiment of an insulated cooler unit 1 according to the invention. The unit 1 in this embodiment has two further or additional fans 32 each connected to at least one further or additional sliding member 52, and wherein each further fan 32 is capable of being slidably moved over a portion of a, preferably an entire, first length (L1) of the first track member 40.

In a preferred embodiment, all of the fans 30 and 32 in the unit 1 are provided with rubber dampers in order to dampen vibrations while the fans are in operation. Thus the rubber dampers may be used to provide a connection between the fan 30 or 32 and the sliding member 50 or 52. In a preferred embodiment, rubber dampers coated with metal or adhesively connected to a metal plate are used. In such preferred embodiments, the rubber damper is thus provided with a slidable metal surface, and it may conveniently be used then itself as a sliding member 50 or 52.

The embodiment of FIG. 2 also shows the feature that the first track member 40 extends a second length (L2) outside a wall 16 of the chamber 10. In this embodiment, the second length (L2) is longer than a width (W) of the first fan 30, and the chamber 10 has a further closable opening 82. The further closable opening 82 according to the invention may be in the form of a door equipped with one or more hinges, a door capable of sliding to the side, or a flap. As shown in the drawing, the further closable opening 82 is suitable for opening such that fans may slide out of the chamber 10 and suitable for closing such that the chamber 10 may remain thermally insulated when in operation. This drawing also shows a mounting space 60 located between the first fan 30 and a further fan 32. A similar mounting space is seen between the further fans 32.

Figure 3:
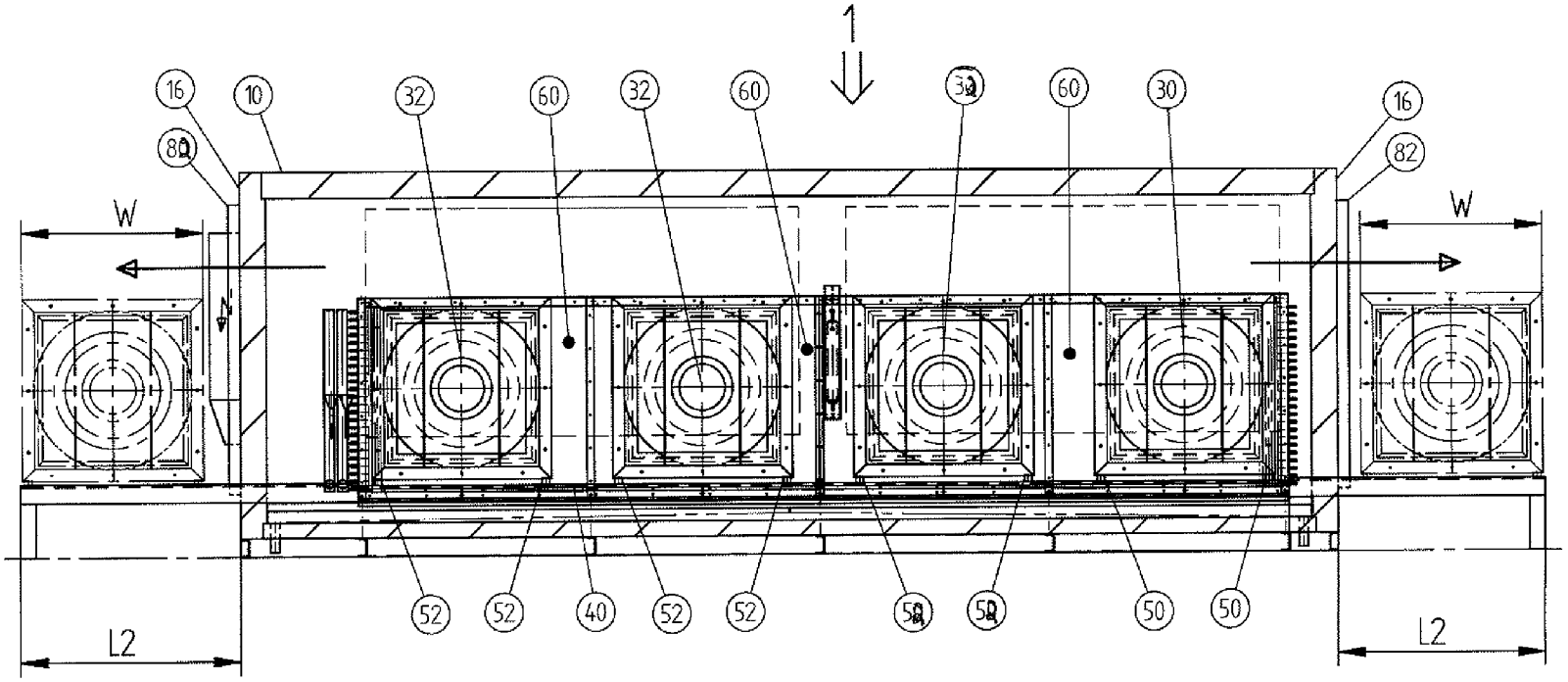
FIG. 3 shows a schematic view of another embodiment of an insulated cooler unit of the invention in which the first track member extends a second length (L2) outside two walls of the thermally-insulated housing chamber.

FIG. 3 shows a schematic view of a preferred embodiment in which the first track member 40 extends a second length (L2) outside two opposite walls 16 of the chamber 10. This embodiment has the benefit that the first fan 30 and a further fan 32 on the opposite side of the chamber 10 may both be slid out of the chamber 10, thus allowing ready access from both sides to the centrally-located further fan 32.

In embodiments having two further closable openings 82, preferably doors, on both sides, as in FIG. 3, the left and right fans, 32 and 30, may be changed without moving a second fan 32. Only in the case of failure of the middle fan 32, the two fans 32 and 30 will have to be removed for maintenance.

In a preferred embodiment, the fans, 30 and 32, are positioned on a support construction behind the coil of the air heat exchanger 20, in a height of approximately half a meter. This support has sliding rails, so that the fans 30 and 32, are mounted on the support and pushed to their final position.

In a preferred embodiment, the second length L2 of the track member(s) 40 and 46 may conveniently be provided by one or more removable accessory stage(s). This accessory stage comprises the second length L2 of the track member(s) 40 and 46, and it may be moved to position at the further closable opening 82, preferably door, and fixed in place there when the removal of a fan 30 or 32 from the unit 1 is desired. Thus when the accessory stage is fixed in position, the fan 30 or 32 may be slid completely out of the unit 1 over the second length L2—without having to carry it—for maintenance or replacement etc. Once the fan 30 or 32 is on the track member(s) 40 and 46 outside the unit on the second length L2, the fan may be moved much more easily. When the fans 30 and 32 are in their normal operating positions inside the unit 1, the accessory stage may then be conveniently removed and stowed out of the way for storage. In a particularly preferred embodiment, an "extended rod system" for a sliding rail is provided as a free assembly.

Figure 4A:
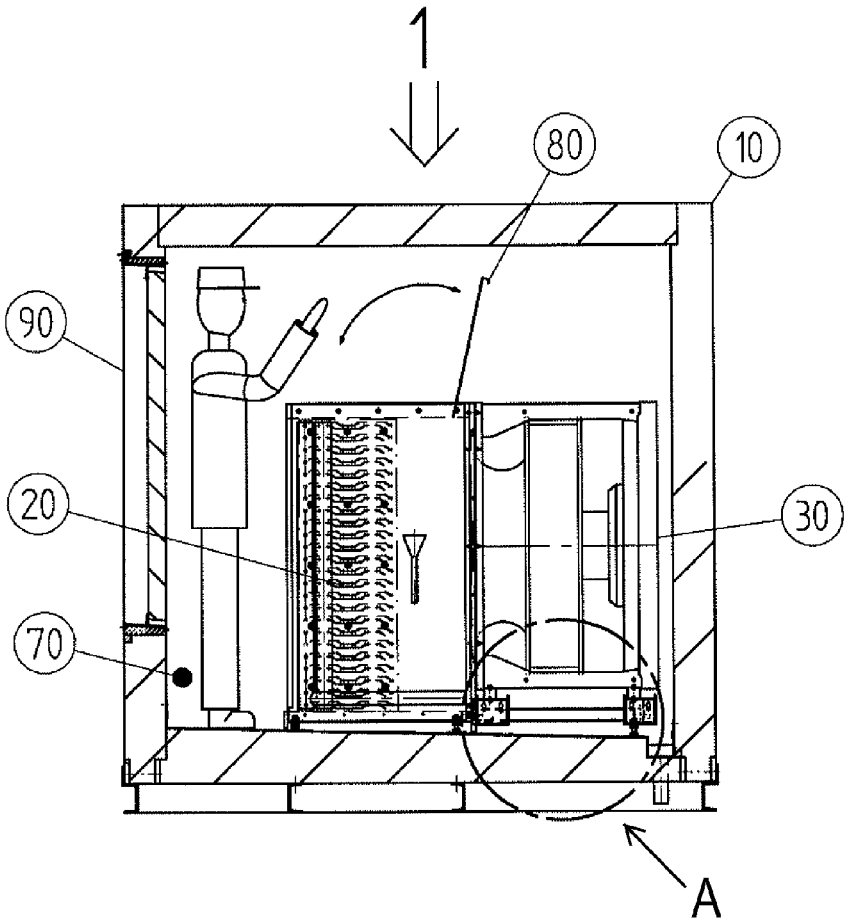
FIGS. 4A and 4B show a schematic view of another embodiment of an insulated cooler unit of the invention having an access space and a first closable opening.
Figure 4B:
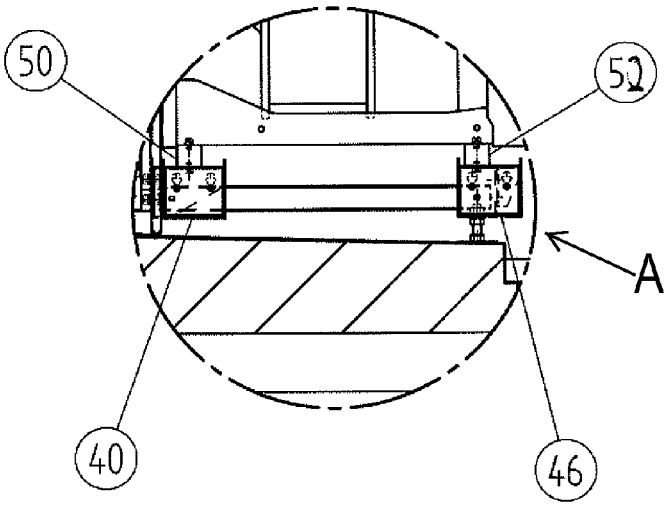

FIGS. 4A and 4B show a schematic view of an embodiment of the unit 1 having an access space 70 suitable for the entrance of a person, wherein the access space 70 and the first fan 30 are located on opposite sides of the air heat exchanger 20. This access space 70 is preferably located on the air flap 90 side and provides a walk-in area for cleaning and inspection purposes. The inlet side of the coil of the air heat exchanger 20 is preferably accessible on its full length and can thus be easily cleaned. Also illustrated is that the air heat exchanger 20 may be accessed for inspection or cleaning purposes by a first closable opening 80 in the form of an inspection cover located above the air heat exchanger 20 and oriented horizontally in the drawing. Inspection covers on top of the coil can quickly be opened and allow one to wash down the coils from top to bottom if necessary. Therefore the coil may conveniently be cleaned while one is standing in an upright position. Also shown in the drawing is the presence of a further track member 46.

Another aspect of the invention is a process of using the unit 1 of the invention in providing cooled air to a refrigeration or freezer room or an air conditioning system in fluid communication with the unit 1. In such processes an inlet of the room or system is in fluid communication with the outlet 14 of the unit 1, and optionally an outlet of the room or system may be in fluid communication with the inlet 12 of the unit 1 in order to provide a recirculation. The flow of air through the unit is illustrated schematically by the use of arrows in FIG. 1, and one skilled in the art will understand that other air flow paths and circulations may be obtained by making use of conventional air flow distributors, manifolds, baffles, deflectors, adjustable flaps, and other internals.

While various embodiments have been set forth for the purpose of illustration, the foregoing descriptions should not be deemed to be a limitation on the scope herein. Accordingly, various modifications, adaptations, and alternatives can occur to one skilled in the art without departing from the spirit and scope herein.

The invention claimed is:

1. An insulated cooler unit for producing cooled air, comprising:

a thermally-insulated housing chamber;

an inlet within the thermally-insulated housing chamber and being configured to introduce air to be cooled;

an outlet within the thermally-insulated housing chamber and being configured to enable cooled air to exit;

an air heat exchanger within the thermally-insulated housing chamber and being configured to cool air;

a first fan;

a first track member;

first and second sliding members configured to slide over the first track member; and a second fan;

the first fan being connected to the first sliding member, being slidably mounted in the first track member by the first sliding member, and being configured to be slidably moved over a portion of a first length of the first track member, the second fan being connected to the second sliding member, being slidably mounted in the first track member by the second sliding member, and being configured to be slidably moved over a portion of the first length of the first track member.

2. The unit of claim 1, further comprising at least a third fan, the third fan being connected to an additional sliding member, being slidably mounted in the first track member by the additional sliding member, and being configured so as to be slidably moved over a portion of the first length of the first track member.

3. The unit of claim 2, wherein a mounting space is located between the first fan, the second fan and the third fan.

4. The unit of claim 2, wherein each of the first fan, the second fan, and the third fan is an electronically commutated fan.

5. The unit of claim 2, wherein each of the first fan, the second fan, and the third fan is mounted on the first track member via the first sliding member, a second sliding member and the additional sliding member in a manner such that a direction of the air flow of each of the first fan, the second fan, and the third fan is substantially perpendicular to a longitudinal axis of the first track member.

6. The unit of claim 2, wherein the first fan, the second fan, and the third fan are mounted in a horizontal axis orientation.

7. The unit of claim 6, wherein the thermally-insulated housing chamber comprises an access space suitable for the entrance of a person, the access space is located on one side of the air heat exchanger, and the first fan, the second fan, and the third fan are located on an opposite side of the air heat exchanger from the access space.

8. The unit of claim 7, wherein the air heat exchanger is capable of being accessed for inspection or cleaning purposes by a first closable opening, located above the air heat exchanger and the first closable opening oriented horizontally.

9. The unit of claim 8, wherein the first closable opening comprises a door.

10. The unit of claim 1, wherein the unit further comprises a second track member, a second sliding member configured to slide over the second track member, wherein the first fan and the second fan are connected to the second sliding member and the first fan and the second fan are slidably mounted in the second track member by the second sliding member, and the first fan and the second fan are capable of being slidably moved over a portion of a first length of the second track member.

11. The unit of 8, wherein the first track member extend a second length outside at least one wall of the thermally-insulated housing chamber, and the second length is longer than a width of the first fan, and the thermally-insulated housing chamber has at least one a second closable opening, the second closable opening is suitable for opening such that the first fan, the second fan, and the third fan are configured to slide out of the thermally-insulated housing chamber over at least a portion of the second length of the first track member, and the second closable opening is suitable for closing such that the thermally-insulated housing chamber remains thermally insulated.

12. The unit of claim 11, wherein the second closable opening comprises a door.

13. A refrigeration or freezer room or an air conditioning system in fluid communication with the unit of claim 1.

14. A method comprising:

operating the unit of claim 1 to provide cooled air to a refrigeration or freezer room or an air conditioning system in fluid communication with the unit.

15. The unit of claim 1, wherein the first track member includes a first channel member and the first sliding member is configured to slide within the first channel member.

16. The unit of claim 10, wherein the second track member includes a second channel member, and the second sliding member is configured to slide the second channel member.

17. The unit of claim 1, wherein the first fan is configured to be slidably moved over an entirety of the first length of the first track member.

18. The unit of claim 2, wherein the third fan is configured to be slidably moved over an entirety of the first length of the first track member.

19. The unit of claim 10, wherein the first fan and the second fan are capable of being slidably moved over an entirety of the first length of the second track member.

20. The unit of claim 11, wherein the first fan, the second fan and the third fan are configured to slide out of the thermally-insulated housing chamber over an entirety of the second length of the first track member.

* * * * *